US007073263B2

(12) United States Patent
Kawasaki

(10) Patent No.: US 7,073,263 B2
(45) Date of Patent: Jul. 11, 2006

(54) HAND-HELD TOOL WITH DISCAL BLADE

(75) Inventor: Yuuji Kawasaki, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 14 days.

(21) Appl. No.: 10/887,391

(22) Filed: Jul. 8, 2004

(65) Prior Publication Data

US 2005/0086811 A1 Apr. 28, 2005

(30) Foreign Application Priority Data

Oct. 22, 2003 (JP) ..... 2003-361921

(51) Int. Cl.
*B26B 29/00* (2006.01)

(52) U.S. Cl. ..... 30/292; 30/319; 30/320

(58) Field of Classification Search ..... 30/319, 30/292–295, 306–307, 160, 335, 162, 320, 30/329–331, 289; 7/103, 113; 83/398, 397
See application file for complete search history.

(56) References Cited

U.S. PATENT DOCUMENTS 4,301,594 A 11/1981 Okada
4,432,137 A * 2/1984 Okada ..... 30/292
5,144,749 A * 9/1992 Chen ..... 30/319
5,355,588 A * 10/1994 Brandenburg et al. ..... 30/319
5,711,077 A 1/1998 Schulz et al.
5,765,289 A 6/1998 Schulz et al.
6,094,824 A * 8/2000 Takeshita ..... 30/276
6,282,794 B1 * 9/2001 Cho et al. ..... 30/151
6,327,783 B1 * 12/2001 Ming ..... 30/292
6,460,254 B1 * 10/2002 Mori et al. ..... 30/286
6,484,405 B1 * 11/2002 Martelli ..... 30/292
2003/0131483 A1 7/2003 Carlson et al.

FOREIGN PATENT DOCUMENTS

EP 0 598 466 5/1994
JP 62-26060 7/1987
JP 2000-254369 9/2000

* cited by examiner

*Primary Examiner*—Kenneth E. Peterson
*Assistant Examiner*—Phong Nguyen
(74) *Attorney, Agent, or Firm*—Hamre, Schumann, Mueller & Larson, P.C.

(57) ABSTRACT

A hand-held tool includes a body having a handle, a discal blade rotatably supported at a tip end of the body, a cover for covering the discal blade at one side in a thicknesswise of the discal blade, an operating member connected to the cover for reciprocal movement in the handle extending direction. The hand-held tool also includes a guide mechanism for guiding the cover along a path inclined relative to the handle extending direction.

10 Claims, 9 Drawing Sheets

FIG. 9a --Prior Art--
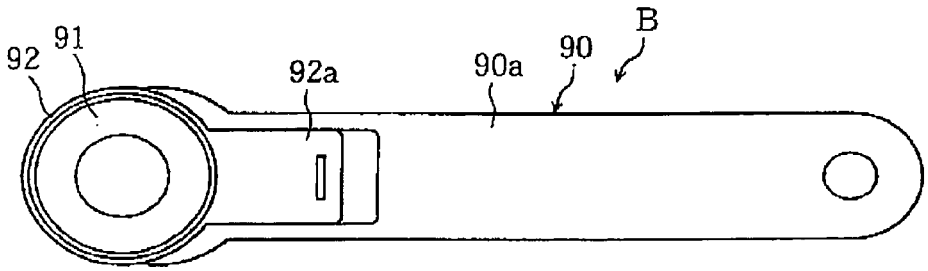
FIG. 9b --Prior Art--
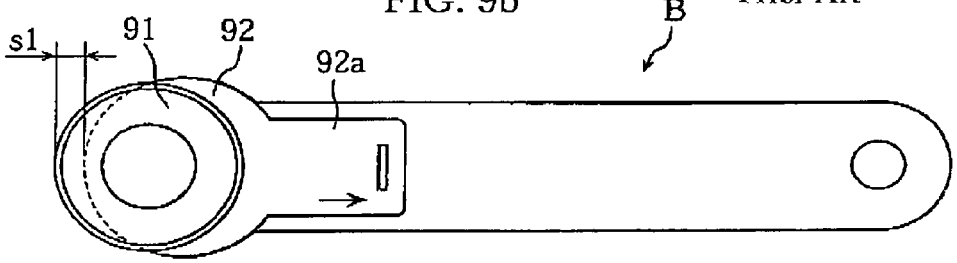
FIG. 10 --Prior Art--
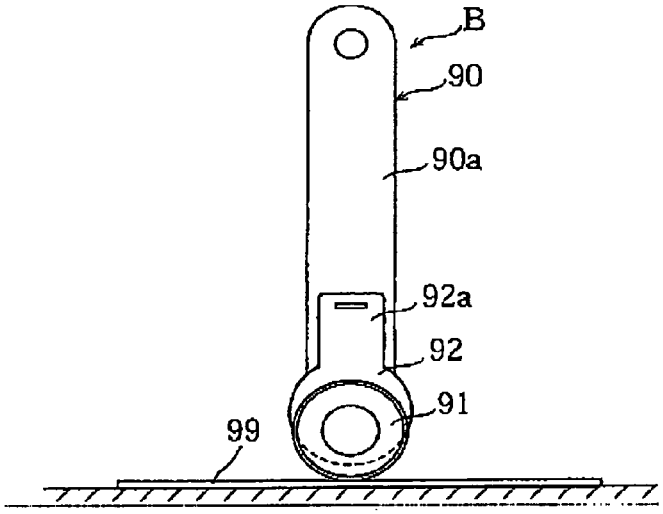

HAND-HELD TOOL WITH DISCAL BLADE

FIELD OF THE INVENTION

The present invention relates to a hand-held tool with a discal blade such as a rotary cutter.

BACKGROUND OF THE INVENTION

An example of conventional rotary cutter is disclosed in JP-Y-57-54780 and shown in FIG. 9*a* of the accompanying drasings. As shown, the rotary cutter B includes a body 90 with a handle 90*a* that extends substantially straight. The body includes a tip end attached with a discal blade 91 for cutting and a cover 92 for covering the outer circumferential cutting edge of the discal blade 91. The discal blade 91 is rotatably supported by non-illustrated a supporting shaft that. On the other hand, the cover 92 includes a rear portion formed as an operating member 92*a*. The operating member 92*a* is operated by a finger to move back and forth longitudinally of the handle 90*a*.

When the rotary cutter B out of use, as shown in FIG. 9*a*, the cover 92 is pushed forwardly. In this state, any part of the discal blade 91 does not protrude beyond the cover 92 radially thereof. As a result, it is possible to reduce the risk that the user's fingers accidentally touch the cutting edge of the discal blade 91. On the other hand, as shown in FIG. 9*b*, when the operating member 92*a* is operated to backwardly move the cover 92, a part (amount s1) of the discal blade 91 forwardly protrudes beyond the cover 92. As a result, it is possible to cut a desired object using the discal blade 91.

According to the above prior art, the cover 92 moves backwardly while the discal blade 91 protrudes beyond the cover 92 at the front end of the rotary cutter B. Due to this structure, when the protruding amount s1 is not large enough, the handle 90*a* of the rotary cutter B should be held at a substantially perpendicular to a cutting target 99 for cutting, as shown in FIG. 10. As a result, difficulty arises in cutting if the handle 90*a* is inclined, for the convenience of cutting. Further, if the rotary cutter is used together with a ruler, the rotary cutter should be preferably inclined for facilitating movement along the ruler. However, as described above, the inclined posture of the handle 90*a* poses difficulty in cutting, making it inconvenient to use the rotary cutter in combination with a ruler.

On the other hand, if the protruding amount s1 of the discal blade 91 is large enough, the problem described above may be resolved. However, when the protruding amount s1 is enlarged, discal blade 91 protrudes excessively beyond the cover 92. Such a structure increases the risk that the user's fingers accidentally touch the cutting edge of the discal blade 91. Additionally, the operating member 92*a* needs to have a large moving stroke for increasing the protruding amount s1.

DISCLOSURE OF THE INVENTION

It is therefore an object of the present invention is to provide a hand-held tool with a discal blade that may be conveniently used without enlarging the protruding amount of the discal blade beyond the cover.

According to the present invention, there is provided a hand-held tool which comprises a body including a handle extending in one direction, a discal blade rotatably supported at a tip end of the body and having a circumferential processing edge, a cover for covering the discal blade at least at one side in a thicknesswise of the discal blade, an operating member connected to the cover for reciprocal movement in the handle extending direction, and a guide mechanism for guiding the cover between a first position and a second position in response to the reciprocal movement of the operating member. The cover in the first position entirely prevents the circumferential processing edge of the discal blade from protruding beyond a peripheral edge of the cover. The cover in the second position allows the circumferential processing edge of the discal blade to partially protrude beyond the peripheral edge of the cover. The guide mechanism causes the cover to move along a path which is inclined relative to the handle extending direction.

Preferably, the guide mechanism comprises a guide slot formed in the cover to be inclined at an angle relative to the handle extending direction, and a holding part fixed to the body to be inserted in the guide slot for regulating the movement of the cover.

In a preferred embodiment, the guide slot penetrates the cover thicknesswise thereof, and the cover is removably attached to the body together with the discal blade. The cover has a first side surface and a second side surface. The guide slot of the cover is inclined in a first direction relative to the handle extending direction when the cover is attached to the body with the first side surface held in contact with the discal blade. Further, the guide slot of the cover is inclined in a second direction, opposite to the first direction, relative to the handle extending direction when the cover is attached to the body with the second side surface held in contact with the discal blade.

Preferably, the operating member is carried by a movable member for reciprocal movement therewith, and the cover includes a connecting portion formed with a through-hole which is pivotally fitted on a pivot post formed on the movable member.

Preferably, the body includes an upper member and a lower member attached to the upper member, and the movable member is sandwiched between the upper member and the lower member under a spring biase.

Preferably, the movable member includes a base slidably contacting the lower member of the body, a riser standing from the base, and an auxiliary piece connected to the riser. In this case, the operating member is carried on the auxiliary piece. Further, it is preferable if the movable member is provided with a spring interposed between the base and the auxiliary piece.

Preferably, the upper member of the body is formed with a opening which is elongated in the handle extending direction for slidably receiving the operating member.

Preferably, the operating member and the movable member are integrally formed as one piece.

Preferably, the discal blade has a circumferential cutting edge.

Other features and advantages of the present invention will be apparent in the following description of the embodiments according to the present invention.

BRIEF DESCRIPTION OF THE DRAWINGS

FIGS. 9*a* and 9*b* are plan views illustrating a prior art rotary cutter.

FIG. 10 is a view showing how the prior art rotary cutter is used for cutting.

DETAILED DESCRIPTION OF THE PREFERRED EMBODIMENTS

A preferred embodiment of the present invention is specifically described below with reference to the accompanying drawings.

Figure 1A:
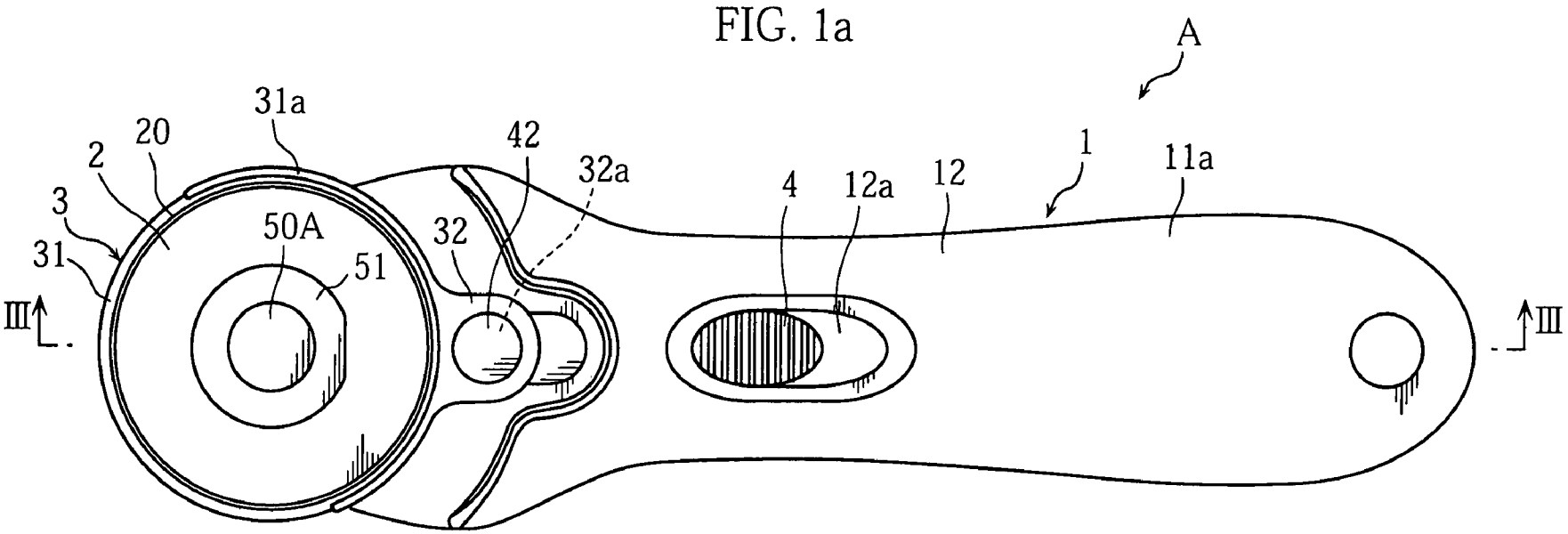
FIG. 1*a* is a plan view illustrating a rotary cutter according to an embodiment of the present invention.
Figure 1B:
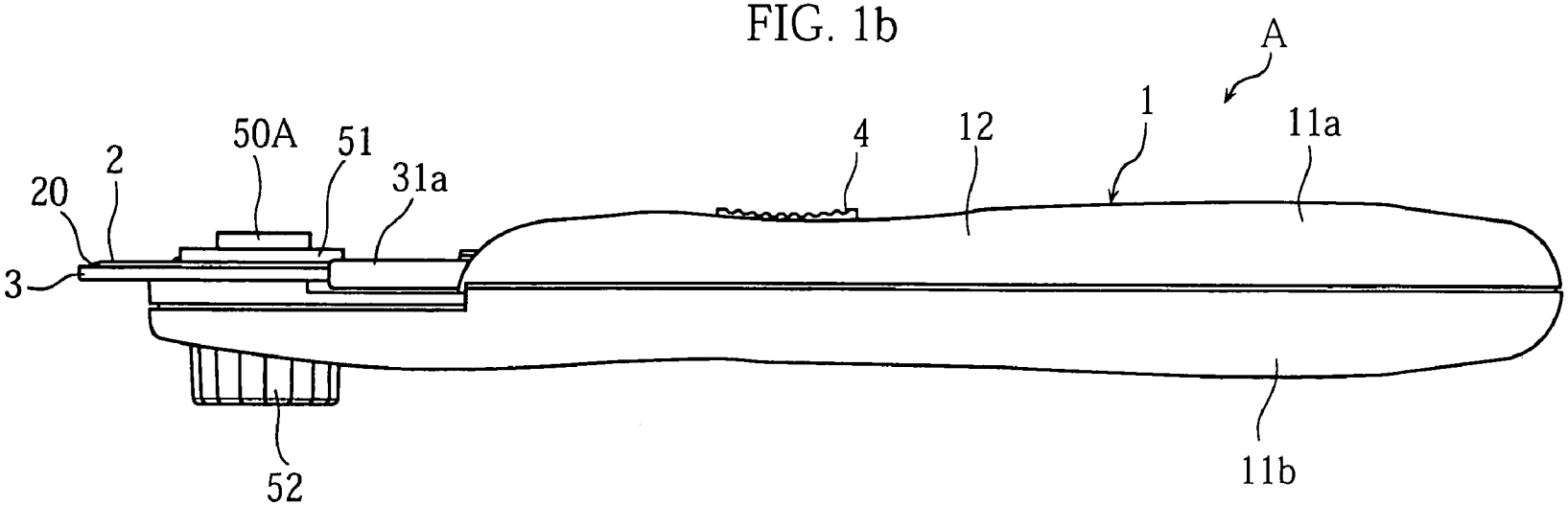
FIG. 1*b* is a side view of the same rotary cutter.
Figure 2:
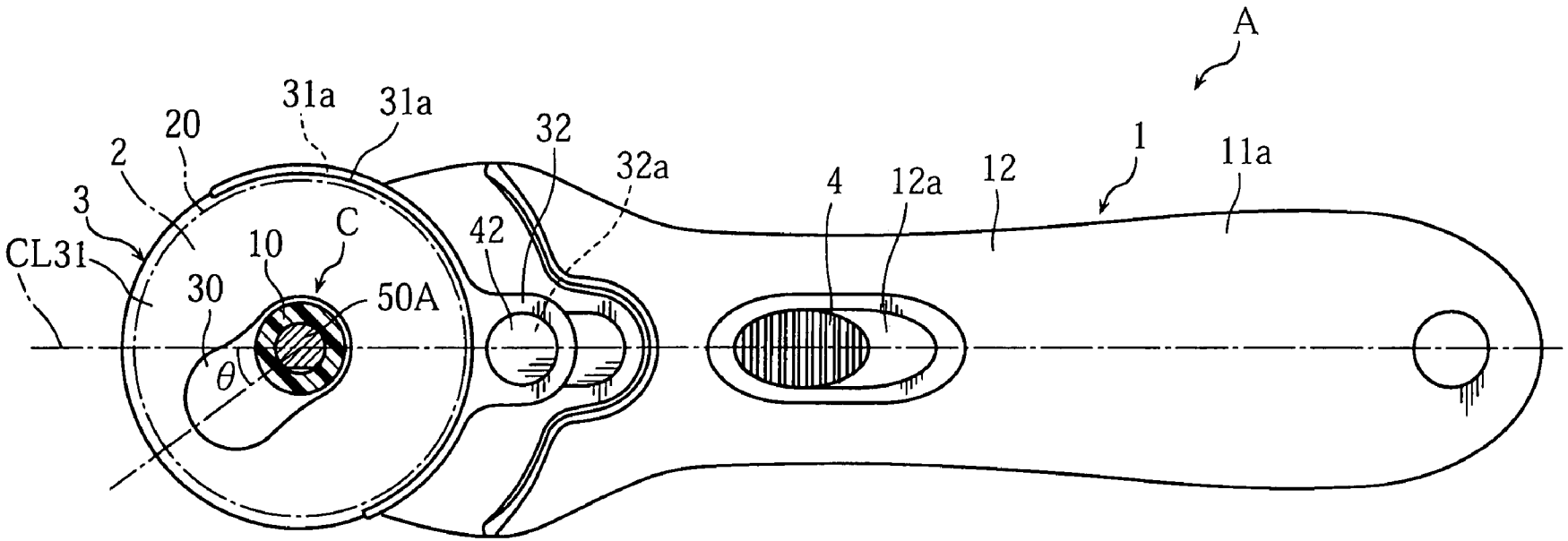
FIG. 2 is a partly sectional plan view of the same rotary cutter.
Figure 3:
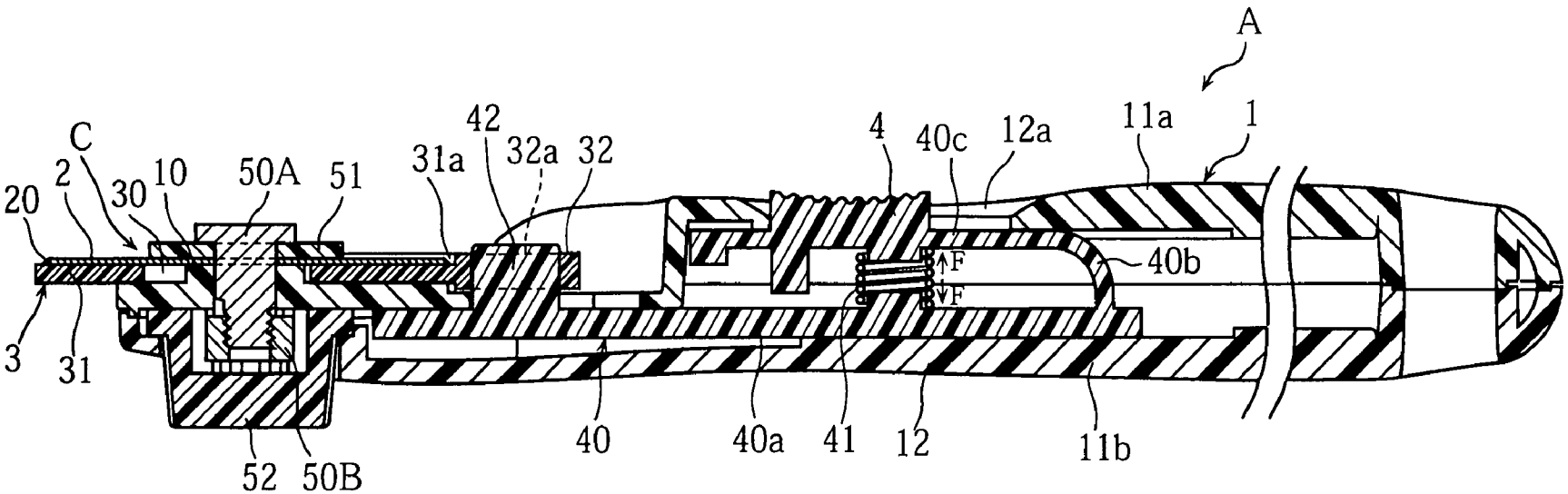
FIG. 3 is a sectional view taken along lines III—III of FIG. 1*a*.

One example of a rotary cutter according to the present invention is illustrated in FIGS. 1 to 8. As shown in FIGS. 1(*a*) and 1(*b*), a rotary cutter A of the present embodiment includes a body 1, a discal blade 2, a cover 3, and an operating member 4. As shown in FIGS. 2 and 3, the rotary cutter A is further provided with a guide mechanism C which includes a holding part 10 integrated with the body 1 and inserted in a slot 30 that penetrates through the cover 3.

The body 1, which is elongated, includes an upper and a lower members 11*a*, 11*b* made of synthetic resin and joined together to form the body. A lengthwise intermediate and a rear portions of the body 1 provide a handle 12 for an user to grip by a hand. The handle 12 is elongated in one direction. This form of the handle 12 prevents the rotary cutter A as a whole from being bulky, while facilitating its storage and carriage.

The discal blade 2 is a thin disc made of stainless steel or other hard metal. The discal blade 2 includes an outer circumference wholly formed as a sharp cutting edge 20. The discal blade 2, as described below, is removably attached to a tip end of the body 1 by a bolt 50A for rotation around the shank of the bolt 50A.

The operating member 4, which is a part for moving the cover 3, is formed as an operating knob that is movable back and forth longitudinally of the handle 12 within an elongated opening 12*a* formed in the handle 12. The operating member 4 is formed integrally with or separately from a movable member 40 slidably arranged in the body 1. The movable member 40 includes a base 40*a* slidably contacting the inner surface of the lower member 11*b*, a riser 40*b* arranged at a rear portion of the base 40*a*, and an auxiliary piece 40*c* supported by the riser 40*b*. The operating member 4 may be integral with or separate from the auxiliary piece 40*c*. Between the underside of the operating member 4 and the base 40*a* is provided a spring 41 that generates a resilient force F. The resilient force F pushes the auxiliary piece 40*c* against the inner surface of the upper member 11*a* while also pushing the underside of the base 40*a* against the inner surface of the lower member 11*b*. Such a pushing force prevents the movable member 40 from being unexpectedly displaced in the longitudinal direction of the handle 12 while providing a suitable resistance against the reciprocating movement of the operating member 4. For more reliably keeping the movable member 40 from being displaced, a releasable engaging means may be provided between the movable member 40 and the body 1, whereby the operating member 4 is pressed against the resilient force F to release the engaging means for allowing the movable member 40 to slide.

The cover 3 prevents the user's fingers from accidentally touching the cutting edge 20 of the discal blade 2. The cover 3 is made of synthetic resin and includes a disc portion 31 which is diametrically larger than the discal blade 2 and has a thicker connecting portion 32 projecting backwardly from the disc portion 31. The disc portion 31 includes an outer circumference provided, at the side adjacent to the handle 12*a*, with a substantially arcuate rib 31*a* for protecting the cutting edge 20 of the discal blade 2. As described below, the cover 3 may be reversible, so that a rib 31*a* is provided on each side of the disc portion 31.

The cover 3 is removably attached to the tip end of the body 1 by the bolt 50A together with the discal blade 2. More precisely, the disc portion 31 of the cover 3 is placed over one side of the body 1 at the tip end thereof, and the discal blade 2 is placed over the disc portion 31. The bolt 50*a* is inserted through the slot 30 of the cover 3 and a through-hole formed at the center of the discal blade 2. The bolt 50*a* is screwed into a nut 50B, whereby the cover 3 and the discal blade 2 are held between the tip end of the body 1 and the head of the bolt 50*a* provided with a washer 51. The nut 50B is fixed in an operation cap 52 that is rotatably attached to the body 1. Due to this structure, the bolt 50A can be easily secured or loosened by turning the operation cap 52. Of course, the bolt 50A should be prevented from idly rotating with the nut while the operation cap is turned. For this purpose, the shank of the bolt 50A may be made noncircular in cross section to be non-rotatable relative to the body 1.

The connecting portion 32 of the cover 3 includes a through-hole 32*a*. The movable member 40 includes a pivot post 42 which is inserted in the through-hole 32*a*. Due to this structure, the cover 3 is connected to the movable member 40 for pivoting in response to a sliding movement of the movable member 40. However, as described below, the moving direction is regulated by the guide mechanism C.

As shown in FIG. 2, the slot 30 of the cover 3 is inclined at an appropriate angle θ relative to a center line CL of the handle 12. The angle θ ranges from 30 to 60 degrees for example. The holding part 10 is a cylinder having slightly smaller diameter than the width of the slot 30. When the cover 3 moves, the holding part 10 slidably contacts the inner surface of the slot 30 for regulating the moving direction while guiding the cover 3. In the present embodiment, the holding part 10 is formed as an integral part of the body 1, but may be formed as a separate part attached to the body 1.

Next, the function and use of the above-described rotary cutter A are described.

First, when the rotary cutter A is not used, as shown in FIGS. 1 to 3, the operating member 4 is disposed at the front end of the opening 12*a*. In this state, the movable member 40 and the cover 3 are at a forward position where the center of the disc portion 31 of the cover 3 matches with the center of the discal blade 2. Thus, the discal blade 2 is wholly covered by the cover 3, whereby no part of the cutting edge 20 of the discal blade 2 protrudes beyond the cover 3. As a result, the user's fingers are protected from accidentally contacting the cutting edge 20.

Figure 4:
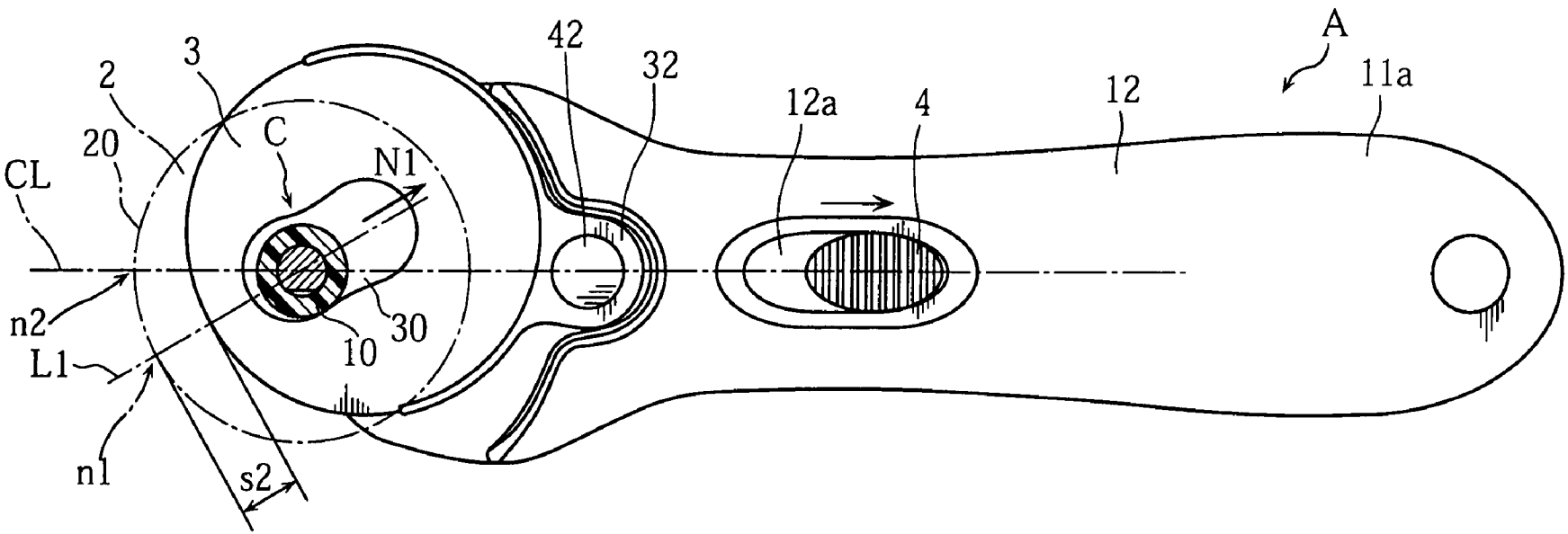
FIG. 4 is a view similar to FIG. 1 but illustrating the same rotary cutter with a cover shifted to a blade exposing position.
Figure 5:
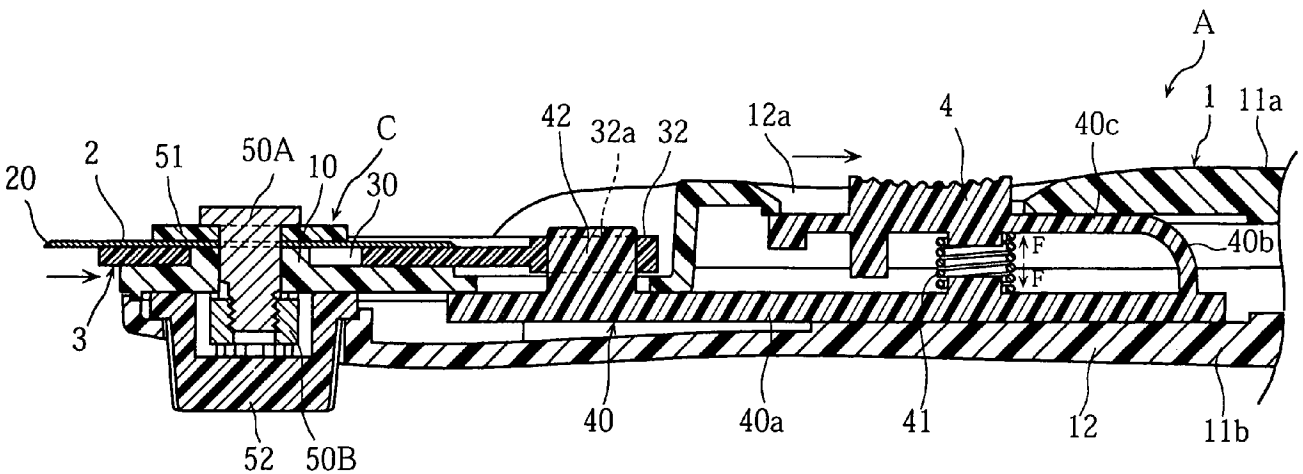
FIG. 5 is a sectional view similar to FIG. 3 but illustrating the same rotary cutter with the cover shifted to the blade exposing position shown in FIG. 4.

Next, when the rotary cutter A is in use, as shown in FIGS. 4 and 5, the operating member 4 is moved backward to the rear end of the opening 12*a*. By this operation, the movable member 40 and the cover 3 are also moved backward. However, the moving direction of the cover 3 is regulated by the interaction of the slot 30 and the holding part 10, thereby moving backward along the longitudinal direction of the slot 30; that is, along an axis L1 that inclines relative to the center line CL of the handle 12, as shown by an arrow N1 in FIG. 4. In this state, the cutting edge 20 of the discal blade 2 protrudes beyond the cover 3 at and around an area n1 on the axis L1. Thus, even if a protruding amount s2 of the cutting edge 20 beyond the cover 3 is not so large at the area n1 on the axis L1, the cutting edge can protrude beyond the cover 3 also at an area n2 on the center line CL corresponding to a tip end of the rotary cutter A. It should be noted that, for ease of understanding, the protruding amount s2 is shown in the figure to be larger than actually is.

With the cutting edge 20 protruding as described above, as shown in FIG. 6, if the handle 12 is inclined relative to a cutting target 99, the cutting edge 20 still contacts the cutting target 99 to facilitate the cutting operation. Of course, as indicated by phantom lines in the figure, even if the handle 12 is held substantially perpendicular to the cutting target 99, the cutting can still be performed reliably. As a result, the user may conveniently use the rotary cutter A without caring about the inclination angle of the handle 12.

The discal blade 2 of the rotary cutter A, as described already, protrudes appropriately beyond the cover 3 at and around the areas n1, n2 that are necessary for cutting, without enlarging the protruding length s2 of the discal blade 2 out of the cover 3. The rotary cutter A doesn't need to enlarge the protruding amount s2, thereby avoiding unnecessarily protruding the area on the cutting edge 20 of the discal blade 2 beyond the cover 3. As a result, it is possible to reduce the risk that the user's fingers or the like accidentally touch the cutting edge 20 in use. Further, due to the absence of the need for excessively enlarging the protruding amount s2, the moving stroke of the operating member 4 may be decreased, whereby the operability of the operating member 4 improves.

Figure 7A:
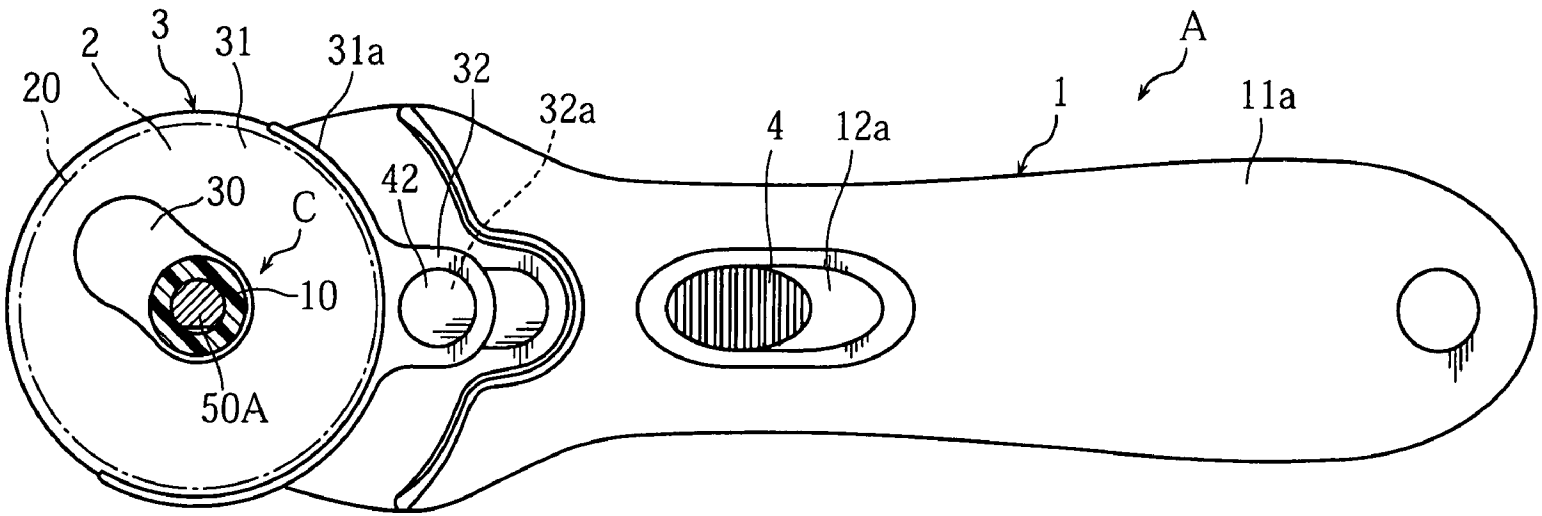
FIG. 7*a* is a partly sectional plan view similar to FIG. 2 but illustrating the same rotary cutter with the cover attached as turned over.
Figure 7B:
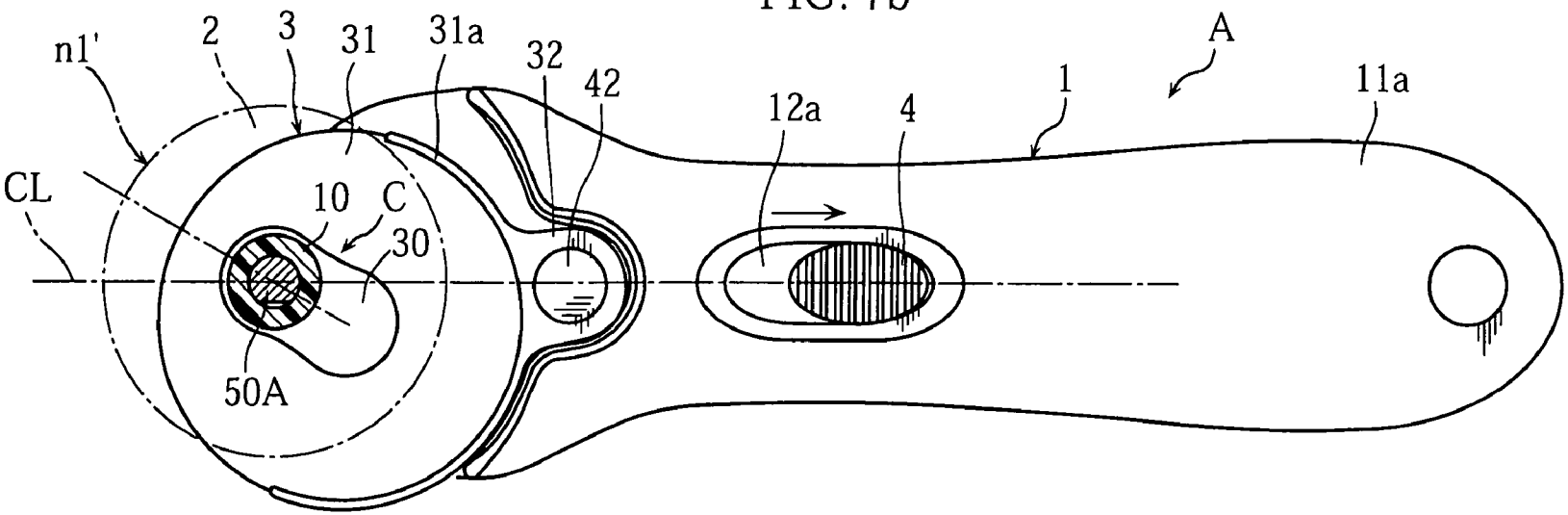
FIG. 7*b* is a partly sectional plan view similar to FIG. 7 but illustrating the same rotary cutter with the cover shifted to a blade exposing position.

The cover 3 of the rotary cutter A is removable from the body 1. The cover 3 may be turned over for attachment to the body 1. When the cover 3 is turned over, as shown in FIG. 7*a*, the slot 30 inclines in the opposite direction. As shown in FIG. 7*b*, when the cover 3 is moved backward in this state, the discal blade 2 protrudes beyond the cover 3 at an area different from the one described above. Accordingly, the largest protruding area is an area n1' which is symmetrical to the area n1 shown in FIG. 4 relative to the center line CL of the handle 12.

Figure 6:
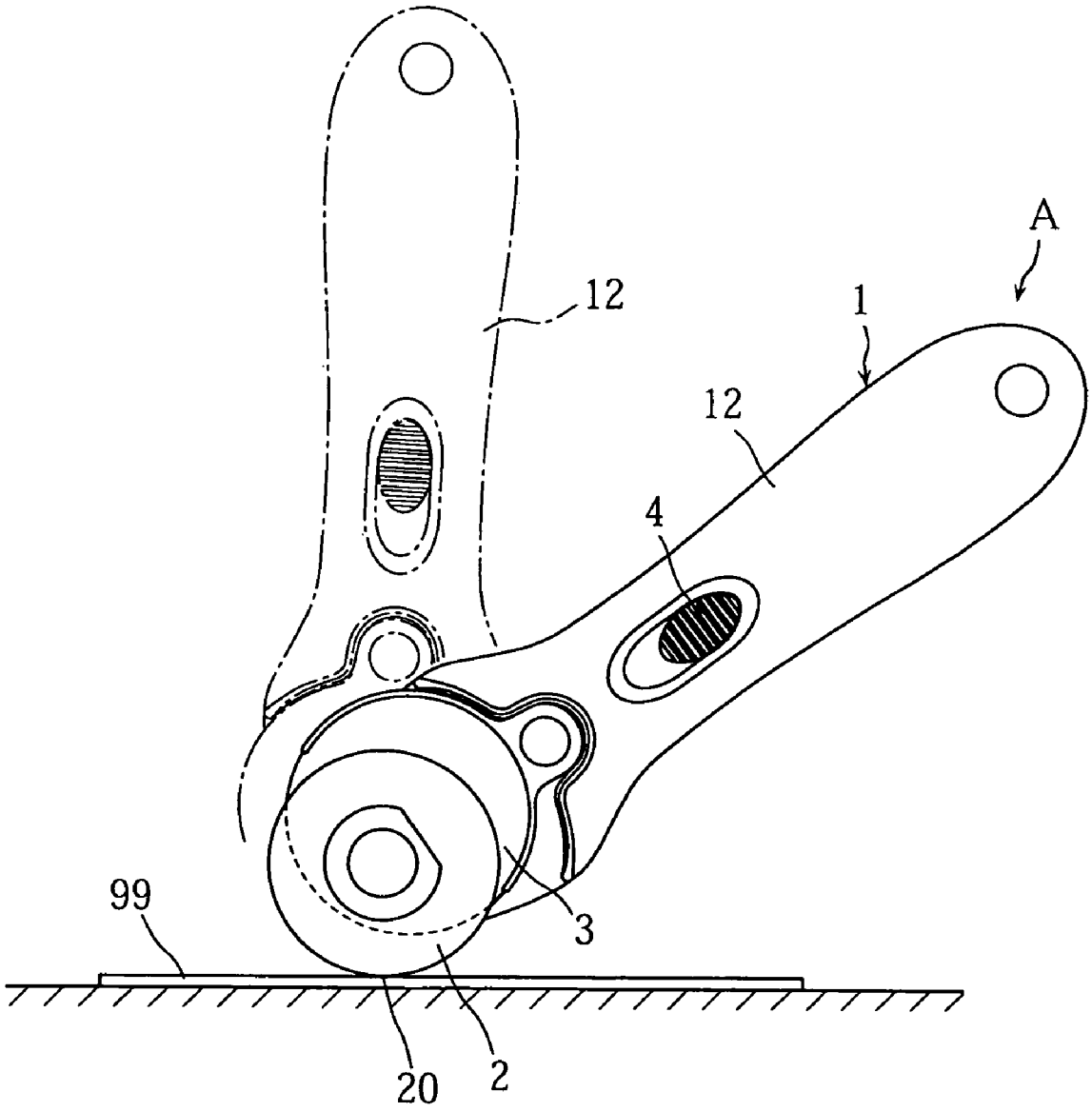
FIG. 6 is a view illustrating how the rotary cutter is used by a right-handed user to cut a cutting target.
Figure 8:
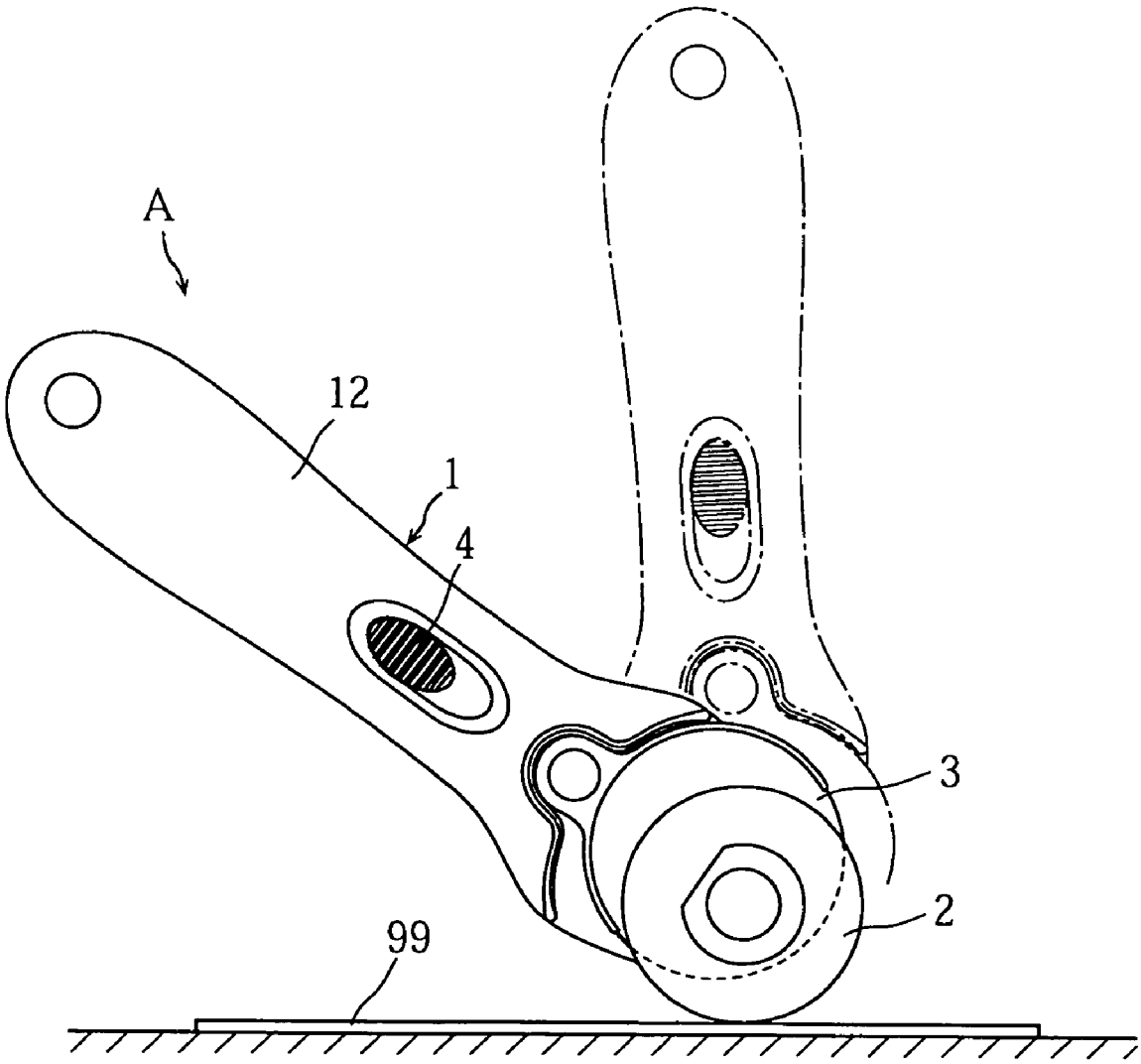
FIG. 8 is a view illustrating how the rotary cutter is used by a left-handed user to cut a cutting target.

In this state, as shown in FIG. 8, when the rotary cutter A is used to cut the cutting target 99, the handle 12 may be inclined in a direction opposite to the one shown in FIG. 6. In use, if the rotary cutter A is held with the right hand, the discal blade 2 is concealed behind the cover 3 so that the discal blade 2 is visible. From this view point, the orientation of the rotary cutter A shown in FIG. 8 is suitable for a left-handed user, while the orientation of the rotary cutter A shown in FIG. 6 is suitable for a right-handed user. In this way, the rotary cutter A may be conveniently used by both of a left-handed user and a right-handed user, simply by turning over the cover 3.

The present invention is not limited to the specific embodiment described above. The configuration of each component of a hand-held tool provided with the discal blade according to the present invention may be variably changed.

The hand-held tool according to the present invention may be designed as a tool other than a rotary cutter. For example, a discal blade may be adopted which has an outer circumference formed with an annular series of piercing teeth thereby providing a perforating tool for forming a line of perforations. In place of a sharp cutting edge for cutting, a discal blade may be employed which has a less sharp embossing edge or teeth to provide a marking tool for forming a continuous or dotted line mark. Further, as a rotary cutter, the cutting edge of a discal blade may be waved for cutting along wavy line.

The guide mechanism according to the present invention may also modified variously as long as it has the function of backwardly guiding the cover along a path inclined relative to the longitudinal direction of the handle. The inclination angle relative to the longitudinal direction of the handle may preferably ranges from 30 to 60 degrees.

The body may also modified variously. For instance, the handle of the body needs not to be straight but may be somewhat bent. The body may further be provided with an attachment that is fixed across the handle. The operating member is preferably designed to be easily operated by the user, but is not limited with respect to its form, material, or layout.

The invention claimed is:

1. A hand-held tool comprising:

a body including a handle extending in one direction;

a discal blade rotatably supported at a tip end of the body and having a circumferential processing edge;

a cover for covering the discal blade at least at one side in a thicknesswise direction of the discal blade;

an operating member connected to the cover for reciprocal movement in the handle extending direction; and a guide mechanism for guiding the cover between a first position and a second position in response to the reciprocal movement of the operating member, the cover in the first position entirely preventing the circumferential processing edge of the discal blade from protruding beyond a peripheral edge of the cover, the cover in the second position allowing the circumferential processing edge of the discal blade to partially protrude beyond the peripheral edge of the cover;

wherein the guide mechanism causes the cover to move along a path which is inclined relative to the handle extending direction;

wherein the guide mechanism comprises a guide slot formed in the cover to be inclined at an angle relative to the handle extending direction, and a holding part fixed to the body to be inserted in the guide slot for regulating the movement of the cover; and wherein the guide slot penetrates the cover thicknesswise thereof, the cover being removably attached to the body together with the discal blade, the cover having a first side surface and a second side surface, the guide slot of the cover being inclined in a first direction relative to the handle extending direction when the cover is attached to the body with the first side surface held in contact with the discal blade, the guide slot of the cover being inclined in a second direction, opposite to the first direction, relative to the handle extending direction when the cover is attached to the body with the second side surface held in contact with the discal blade.

2. The hand-held tool according to claim 1, wherein the discal blade has a circumferential cutting edge.

3. A hand-held tool comprising:

a body including a handle extending in one direction;

a discal blade rotatably supported at a tip end of the body and having a circumferential processing edge;

a cover for covering the discal bJade at least at one side in a thicknesswise direction of the discal blade;

an operating member connected to the cover for reciprocal movment in the handle extending direction; and a guide mechanism for guiding the cover between a first position and a second position in response to the reciprocal movement of the operating member, the cover in the first position entirely preventing the circumferential processing edge of the discal blade from protruding beyond a peripheral edge of the cover, the cover in the second position allowing the circumferential processing edge of the discal blade to partially protrude beyond the peripheral edge of the cover;

wherein the guide mechanism causes the cover to move along a path which is inclined relative to the handle extending direction, and wherein the operating member is carried by a movable member for reciprocal movement therewith, the cover including a connecting portion formed with a through-hole which is pivotally fitted on a pivot post formed on the movable member.

4. The hand-held tool according to claim 3, wherein the body includes an upper member and a lower member attached to the upper member, the movable member being sandwiched between the upper member and the lower member under a spring biase.

5. The hand-held tool according to claim 4, wherein the movable member includes a base slidably contacting the lower member of the body, a riser standing from the base, and an auxiliary piece connected to the riser, the operating member being carried on the auxiliary piece, the movable member being provided with a spring interposed between the base and the auxiliary piece.

6. The hand-held tool according to claim 4, wherein the upper member of the body is formed with a opening which is elongated in the handle extending direction for slidably receiving the operating member.

7. The hand-held tool according to claim 3, wherein the operating member and the movable member are integrally formed as one piece.

8. The hand-held tool according to claim 3, wherein the discal blade has a circumferential cutting edge.

9. The hand-held tool according to claim 3, wherein the guide mechanism comprises a guide slot formed in the cover to be inclined at an angle relative to the handle extending direction, and a holding part fixed to the body to be inserted in the guide slot for regulating the movement of the cover.

10. The hand-held tool according to claim 9, wherein the guide slot penetrates the cover thicknesswise thereof, the cover being removably attached to the body together with the discal blade, the corver having a first side surface and a second side surface, the guide slot of the cover being inclined in a first direction relative to the handle extending direction when the cover is attached to the body with the first side surface held in contact with the discal blade, the guide slot of the cover being inclined in a second direction, opposite to the first direction, relative to the handle extending direction when the cover is attached to the body with the second side surface held in contact with the discal blade.

* * * * *